US005819356A

United States Patent [19]

Cann

[11] Patent Number: 5,819,356

[45] **Date of Patent: *Oct. 13, 1998**

[54] TWIST MOP

[75] Inventor: Robert A. Cann, Amherst, Mass.

[73] Assignee: Easy Day Manufacturing Company, Holliston, Mass.

[ * ] Notice: The term of this patent shall not extend beyond the expiration date of Pat. No. 5,642,551.

[21] Appl. No.: 798,854

[22] Filed: Feb. 12, 1997

Related U.S. Application Data

[63] Continuation-in-part of Ser. No. 684,176, Jul. 19, 1996, Pat. No. 5,642,551.

[51] Int. Cl.[6] ..... A47L 13/142

[52] U.S. Cl. ..... 15/120.1

[58] Field of Search ..... 15/116.1, 116.2, 15/119.1, 119.2, 120.1, 120.2

[56] References Cited

U.S. PATENT DOCUMENTS

| | | | |
|---|---|---|---|
| 1,514,051 | 11/1924 | Jumonville | 15/120.2 |
| 3,151,475 | 10/1964 | Johnson | 15/120.1 X |
| 4,479,278 | 10/1984 | Heinonen | 15/120.2 |
| 5,509,163 | 4/1996 | Morad | 15/120.2 |
| 5,566,417 | 10/1996 | Hsieh | 15/120.2 |
| 5,577,290 | 11/1996 | Monahan | 15/120.1 |

*Primary Examiner*—Mark Spisich

*Attorney, Agent, or Firm*—Wolf, Greenfield & Sacks, P.C.

[57] ABSTRACT

In a preferred embodiment of the invention, a mop is disclosed, comprising a handle, a mop head and a wringing grip slidably and rotatably mounted on the handle. The mop head is coupled between the wringing grip and the handle such that upon rotation of the wringing grip relative to the handle, the mop head is wrung. The wringing grip includes an element for engaging the handle when the wringing grip is compressed against the handle to facilitate wringing of the mop head by inhibiting the wringing grip from rotating relative to the handle. The engaging element comprises at least one protrusion which extends inwardly from the wringing grip toward the handle, and the at least one protrusion comprises an insert which is located within at least one opening in the wringing grip.

20 Claims, 7 Drawing Sheets

TWIST MOP

This application is a continuation-in-part of application Ser. No. 08/684,176, filed Jul. 19, 1996. now U.S. Pat. No. 5,642,551.

FIELD OF THE INVENTION

The present invention relates to a twist mop having an improved integral wringing mechanism.

BACKGROUND OF THE INVENTION

It is known to provide a mop with an integral wringing mechanism to wring fluid from the mop head. Integral wringing mechanisms come in many forms and enable the user of the mop to wring out the mop head without the need for an additional, wringing mechanism which is separate from the mop. One such prior art mop is shown in FIG. 1. This type of mop, commonly referred to as a "twist mop," includes a handle 10 surrounded by a wringing grip 12. Wringing grip 12 slides along handle 10. A mop head 14 is mounted between a mounting area 16 of wringing grip 12 and mounting bracket 18, which is attached to the distal end of handle 10. The portion of handle 10, which is located within mop head 14, is shown in phantom in FIG. 1. A fixed grip 20 is mounted to handle 10 in order to provide another gripping surface. In use, wringing grip 12 is slid toward mounting bracket 18 of handle 10, which causes mop head 14 to slacken, thereby providing a surface area of mop head 14 with which the user may mop a particular surface.

When the mop head 14 is to be wrung, wringing grip 12 is slid along handle 10 toward fixed grip 20, such as shown in FIG. 1, in order to stretch the mop head 14 between mounting brackets 16 and 18. Wringing grip 12 and fixed grip 20 then are rotated in opposite directions to twist mop head 14 and wring out any fluid in the mop head. In this prior art design, however, since wringing grip 12 is designed to be noncompressible, twisting the mop head to wring it requires the user to have both hands on the mop at all times while the mop head is being twisted, since, if either the wringing grip 12 or the fixed grip 20 are released while the mop head is being twisted, the mop head will spring back into its normal, relaxed position. As a result, twisting the mop head is difficult and often results in a less than complete wringing of fluids from the mop head. In addition, since both hands need to be used, extra energy and strength on the part of the user are necessary. This problem is magnified in the case of users with arthritis or limited hand strength.

Another prior art wringing system uses a plastic ratchet system which, while addressing the problem of the prior art mop of requiring the user to use both hands to wring the mop head, is cumbersome, more expensive, more complicated to use and requires numerous plastic pieces, which are prone to breakage.

It thus would be desirable to provide a simplified mop wringing system which is easy to use and does not require the user to have both hands on the mop at all times to prevent the mop head from untwisting while it is being wrung.

SUMMARY OF THE INVENTION

According to a general aspect, the invention features a twist mop having a wringing grip which enables the user to hold the handle in a fixed position after each twist of the mop head relative to the handle. The wringing grip is compressible against the handle in order to allow the user to squeeze the handle with the wringing grip to prevent the handle, and consequently the mop head, from untwisting.

In a preferred embodiment of the invention, a mop is disclosed, comprising a handle, a mop head and a wringing grip slidably and rotatably mounted on the handle. The mop head is coupled between the wringing grip and the handle such that upon rotation of the wringing grip relative to the handle, the mop head is wrung. The wringing grip includes means for engaging the handle when the wringing grip is compressed against the handle to facilitate wringing of the mop head by inhibiting the wringing grip from rotating relative to the handle. The engaging means comprises at least one protrusion which extends inwardly from the wringing grip toward the handle, and at least one protrusion comprises a rubber insert which is located within at least one opening in the wringing grip. Opposite ends of the insert may be fixed to the wringing grip at opposite ends of the openings, such that when a radially inward force is applied to the insert, a middle portion, between the opposite ends, engages the handle.

In another embodiment of the invention, a wringing mechanism for a mop is disclosed, comprising a pliable wringing grip having a bore through which a mop handle is inserted. A mop head is coupled between the wringing grip and the handle such that upon rotation of the wringing grip relative to the handle, the mop head is wrung. The pliable wringing grip comprises at least one protrusion disposed along an internal wall of the pliable wringing grip and extending inwardly toward the handle. Upon application of an inwardly radial force to the wringing grip, the protrusion engages the handle, thereby inhibiting movement of the handle relative to the pliable wringing grip. At least one protrusion comprises a tackified inner surface which engages the handle.

In another embodiment of the invention, a mop is disclosed, comprising a handle, a mop head attached to the handle and a grip portion slidably and rotatably mounted on the handle and operatively coupled to the mop head, such that upon rotation of the grip portion relative to the handle, the mop head is twisted. The grip portion has means for engaging the handle, such that when a force is applied to the engaging means, the wringing grip is inhibited from moving relative to the handle.

DETAILED DESCRIPTION

Figure 1:
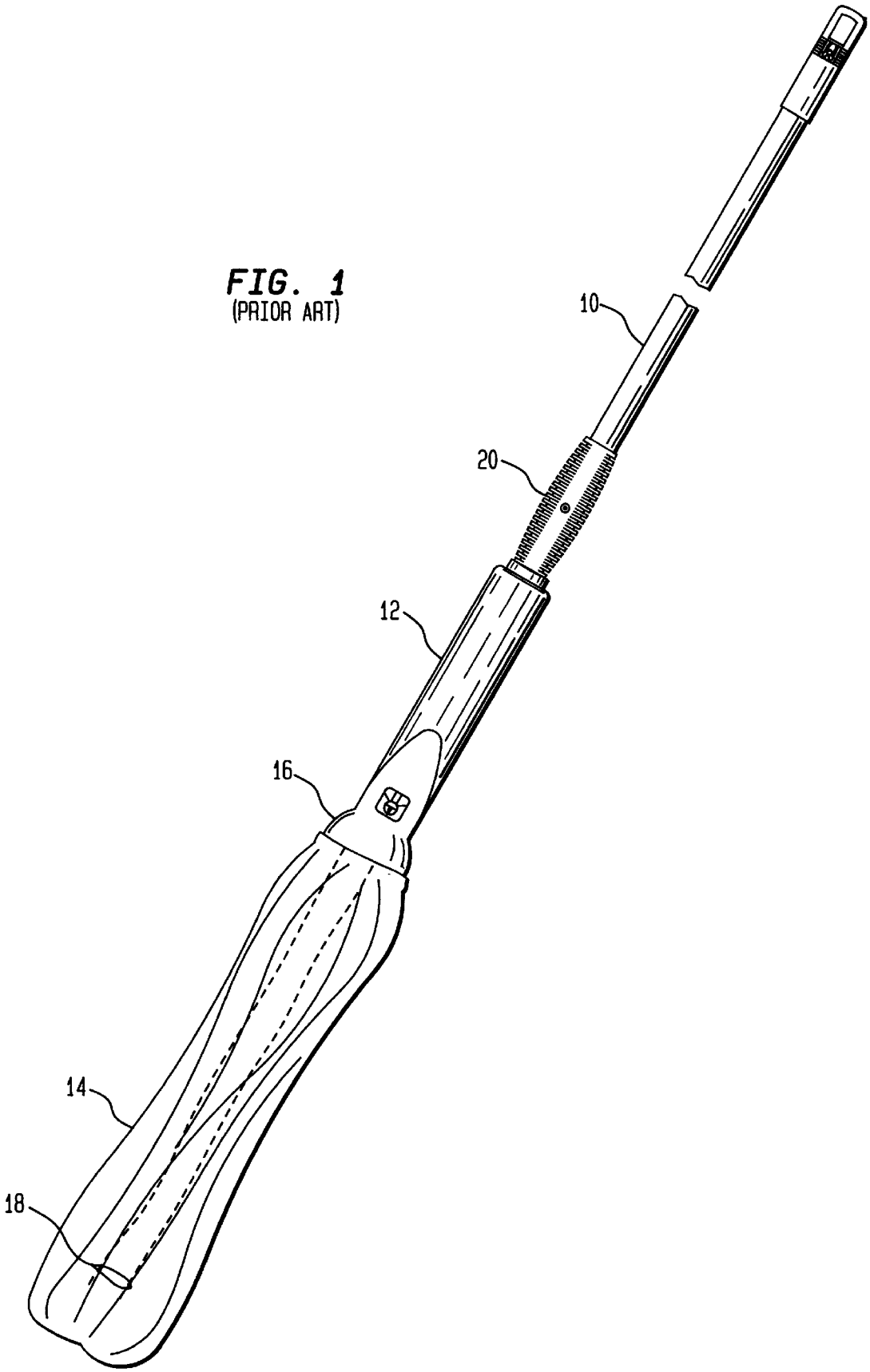
FIG. 1 (PRIOR ART)
FIG. 1 is an illustration of a prior art twist mop.
Figure 2:
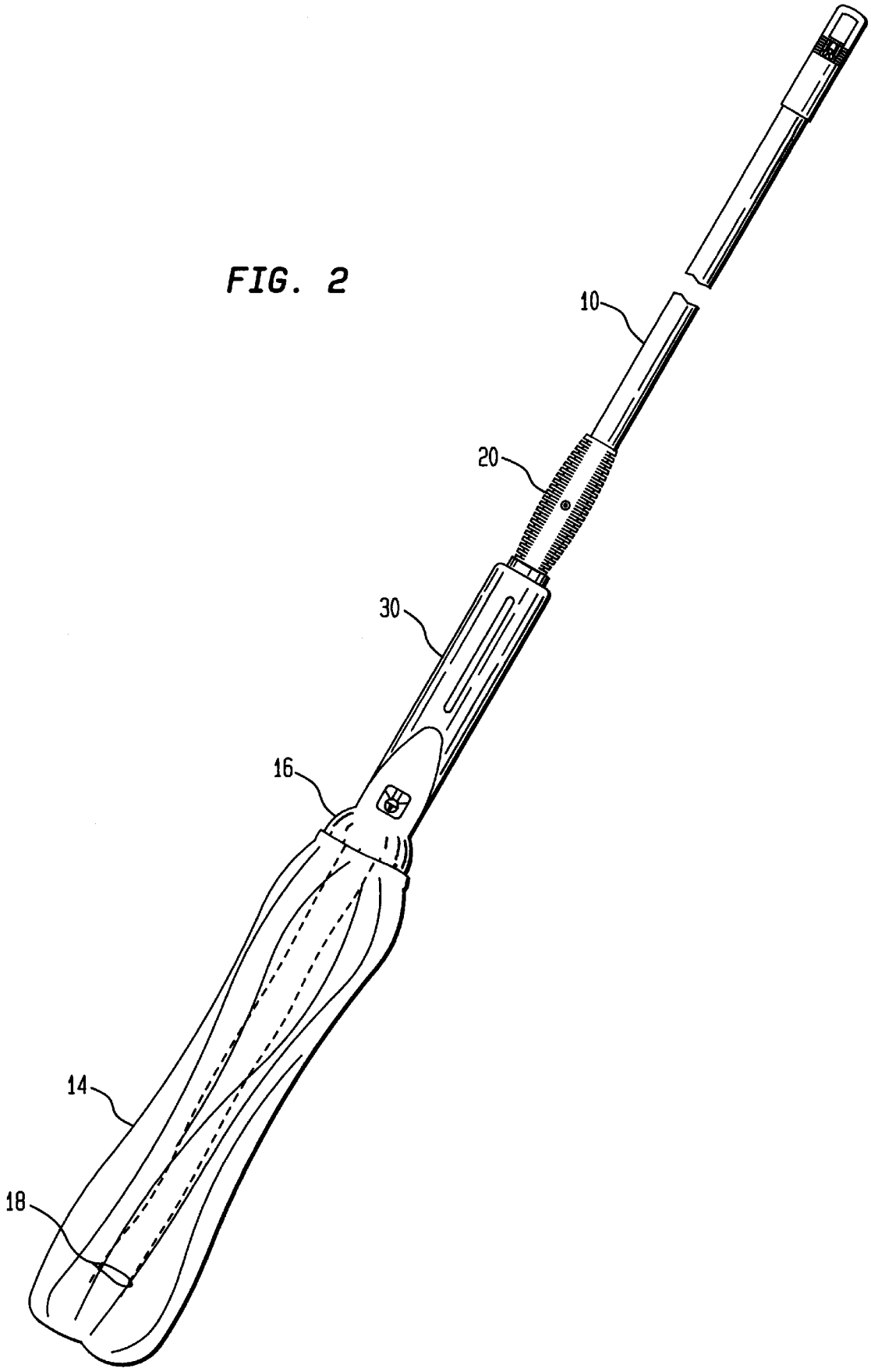
FIG. 2 is an illustration of a twist mop in accordance with the present invention.
Figure 3:
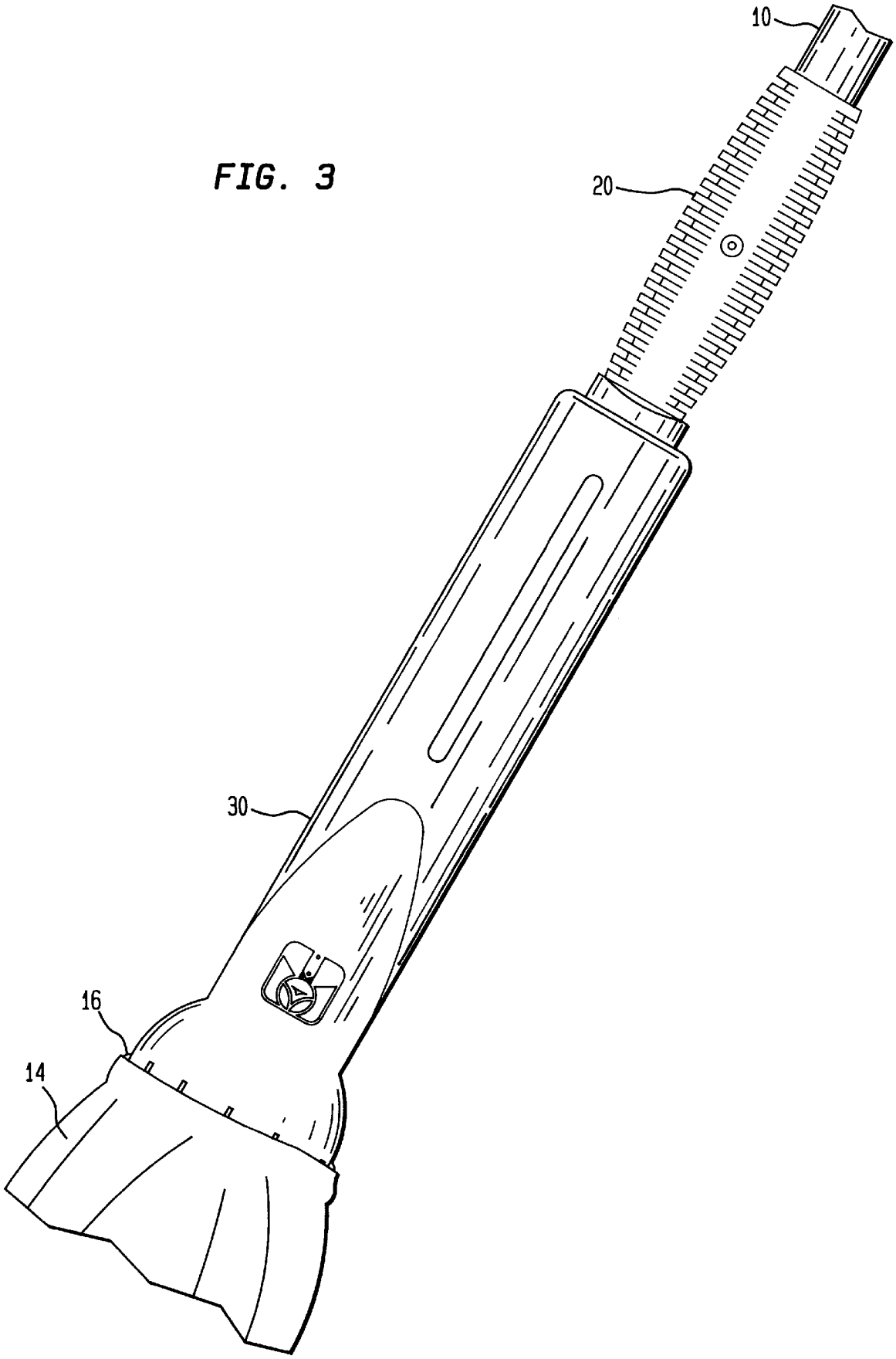
FIG. 3 is a close-up view of the wringing grip in accordance with the present invention.

The twist mop of the present invention is shown in FIG. 2. Similar to the prior art twist mop of FIG. 1, the present invention includes a handle 10, a mop head 14 mounted between mounting brackets 16 and 18, and a fixed grip 20 mounted to handle 10. However, wringing grip 30 of the present invention, which is preferably hollow and circumferentially surrounds handle 10, is compressible. Therefore, when wringing grip 30 is depressed radially inwardly against handle 10, wringing grip 30 engages handle 10 to prevent handle 10 from rotating relative to wringing grip 30 while the mop head 14 is being wrung between wringing grip 30 at bracket 16 and handle 10 at bracket 18. A close-up view of wringing grip 30, as well as handle 10, mop head 14, mounting bracket 16 and fixed grip 20 is shown in FIG. 3.

Figure 4A:
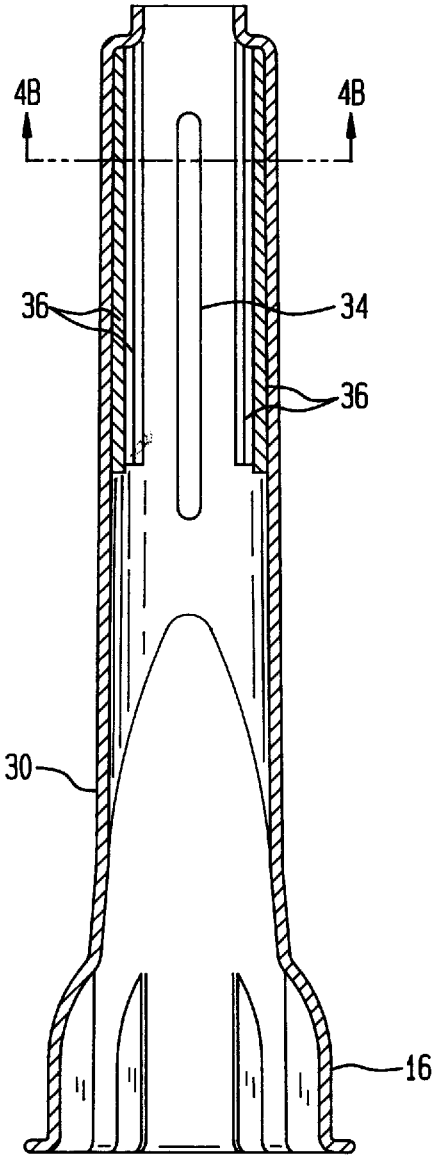
FIG. 4A is a cut-away view of the wringing grip in accordance with the present invention.

FIG. 4A is a cut-away view showing the details of wringing grip 30. In one embodiment, wringing grip 30 comprises opposing openings 34 (only one of which is shown), which may be longitudinal slots, located in the upper portion of wringing grip 30. Wringing grip 30 also comprises opposing longitudinal ribs 36 located along the inside wall of wringing grip 30. Openings 34 facilitate the compression of wringing grip 30. Openings 34 need not be longitudinal slots (as shown). They may be any other shape, and may comprise a series configuration of smaller openings. Wringing grip 30 is designed so that it is capable of being in two states: a relaxed state, when the grip is at rest and is rotatable about handle 10, and a compressed state, when the grip is compressed and is fixed with respect to handle 10.

Figure 4B:
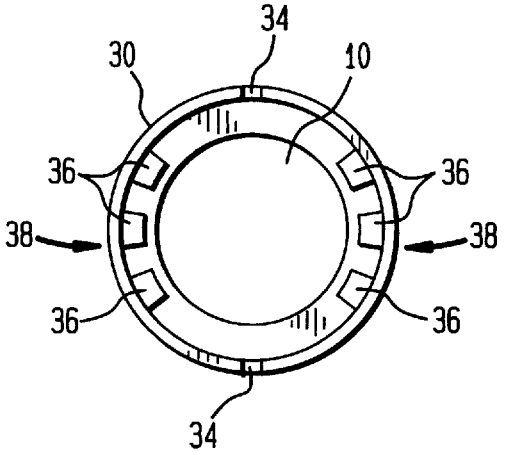
FIG. 4B is a cross-sectional view of the wringing grip in accordance with the present invention.

FIG. 4B is a cross-sectional view of wringing grip 30, along lines 4b—4b of FIG. 4A. In this embodiment, the cross-section of wringing grip 30 is circular, however, any suitable cross-sectional shape, such as an elliptical shape, may be used in the manufacture of wringing grip 30. When force is applied to wringing grip 30 at the areas over the longitudinal ribs and in the radial directions toward handle 10 indicated by arrows 38, such as when the user squeezes wringing grip 30 with his or her hand, the grip is compressed, causing ribs 36 to come into contact with handle 10. The resulting friction holds handle 10 in place relative to wringing grip 30. This enables the user to twist wringing grip 30 with one hand and handle 10 with the other hand in opposite directions to the extent possible by the human hand, then compress wringing grip 30 against handle 10 with the one hand in order to hold handle 10 in place relative to wringing grip 30, while repositioning the other hand on handle 10 in order to further twist the handle to wring mop head 14. This twisting process is repeated until the mop head is sufficiently wrung. This eliminates the need for the user to be constantly holding on to the mop with both hands in order to prevent the mop head from untwisting. As a result, the mop is easier to use and requires less energy and strength to wring fluid from the mop head.

In another embodiment, wringing grip 30 is formed from a material which is pliable enough to eliminate the need for openings 34. Therefore, when wringing grip 30 is compressed, handle 10 is held in place relative to wringing grip 30 as described above. Examples of usable materials include plastic, rubber and urethane.

Figure 5:
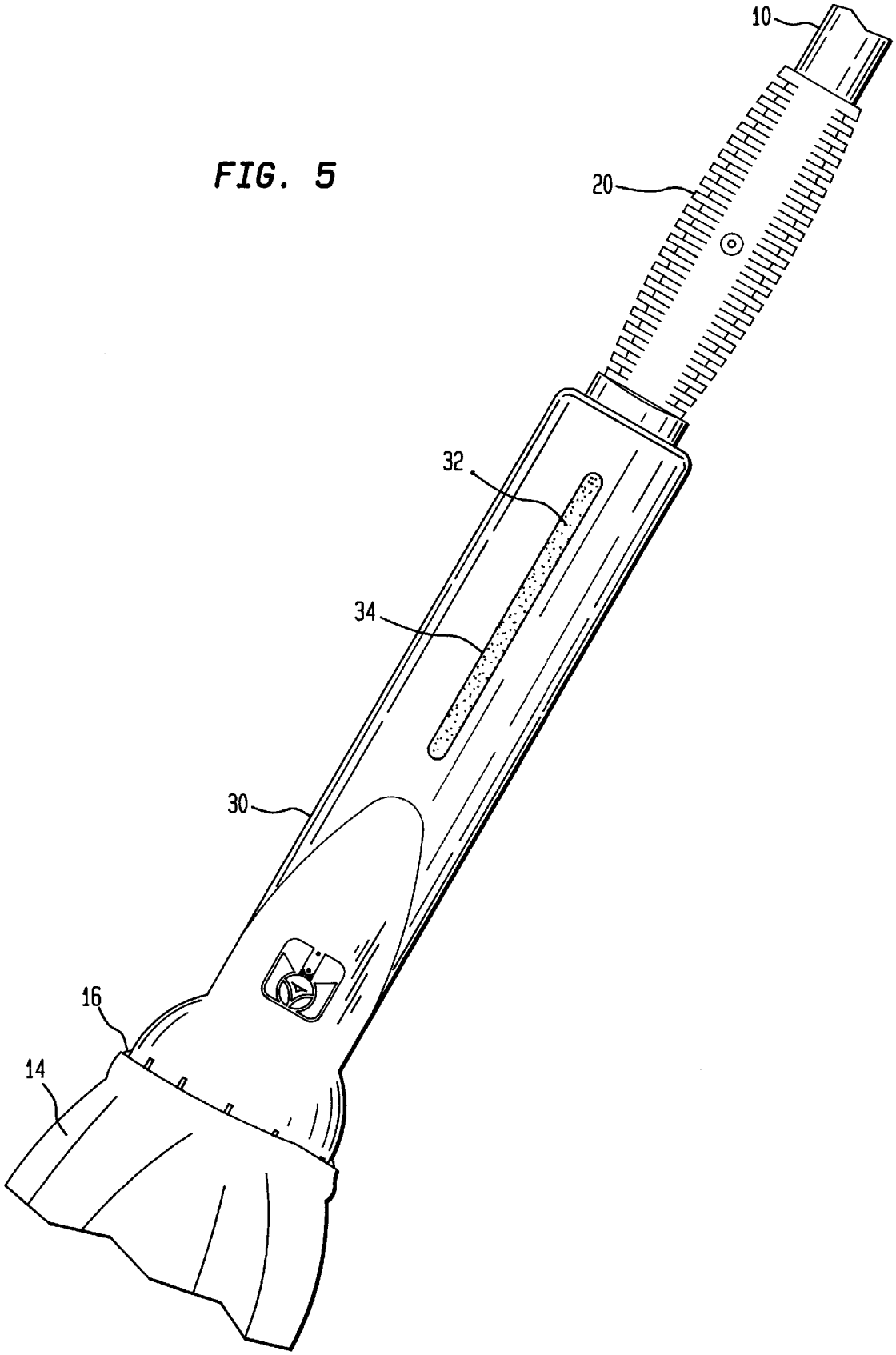
FIG. 5 is a close-up view of the wringing grip in accordance with a second embodiment of the present invention.
Figure 6A:
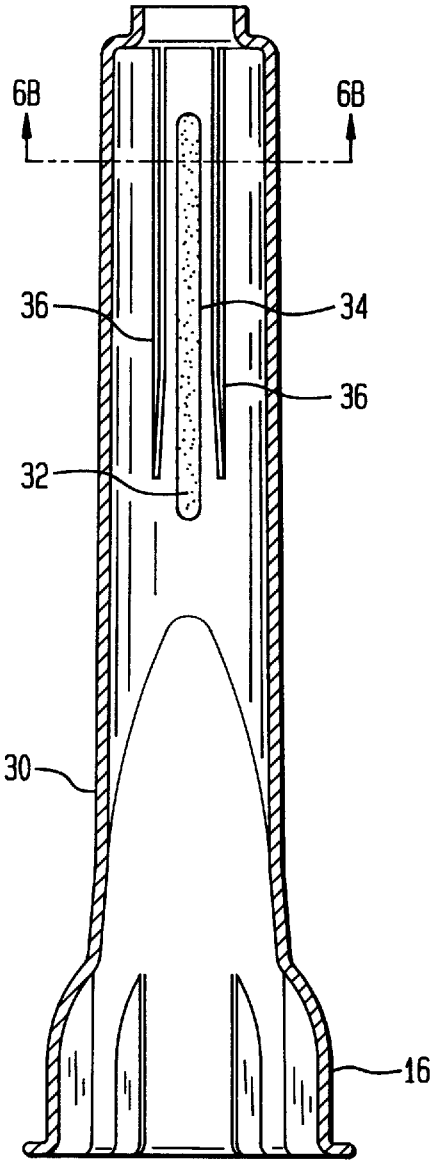
FIG. 6A is a cut-away view of the wringing grip of the second embodiment of the present invention.

In another embodiment, shown in FIG. 5, wringing grip 30 includes inserts 32 (one of which is shown) which are located within openings 34 and attached to wringing grip 30. FIG. 6A is a cut-away view showing the details of the wringing grip 30 of this embodiment. Features which are the same as the features of the embodiment of FIGS. 2–4 are referred to with the same reference numerals as in FIGS. 2–4. In this embodiment, openings 34 are longitudinal slots and inserts 32 are substantially the same shape and size as openings 34, such that inserts 32 may be tensionally fit into openings 34. However, openings 34 need not be longitudinal slots. They may be any other shape, and may comprise a series configuration of smaller openings. Accordingly, inserts 32 also may be the shape of openings 34 or may comprise a series configuration of smaller inserts which are fit into a corresponding series configuration of openings 34. Examples of usable materials in the manufacture of inserts 32 include elastomer, rubber, plastic and urethane. Inserts 32 may be tensionally fit into openings 34. Inserts 32 also may be attached to wringing grip 30 with an adhesive, or they may be attached to wringing grip 30 by any other suitable method. Longitudinal ribs 36 are located adjacent to each insert 32 and provide structural support to wringing grip 30.

Figure 6B:
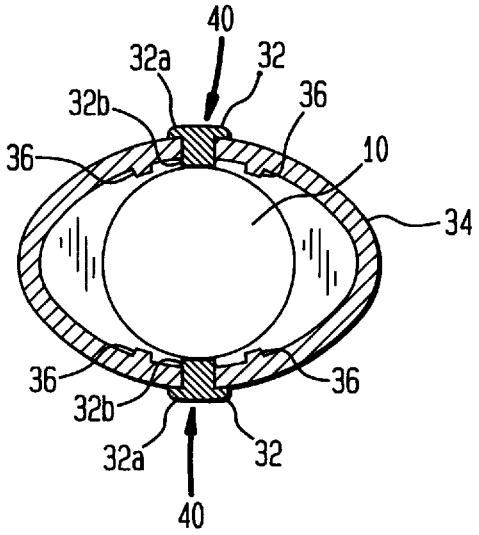
FIG. 6B is a cross-sectional view of the wringing grip of the second embodiment of the present invention.

FIG. 6B is a cross-sectional view of wringing grip 30 along line 6b—6b of FIG. 6A. In this embodiment, the cross-section of wringing grip 30 is elliptical, however, any suitable cross-sectional shape, such as a circular shape, may be used in the manufacture of wringing grip 30. As is shown in FIG. 6B, inserts 32 are press fit into openings 34 such that an outer portion 32*a* of inserts 32 extends outwardly beyond wringing grip 30, and an inner portion 32*b* of inserts 32 extends inwardly from wringing grip 30 toward handle 10.

Figure 7A:
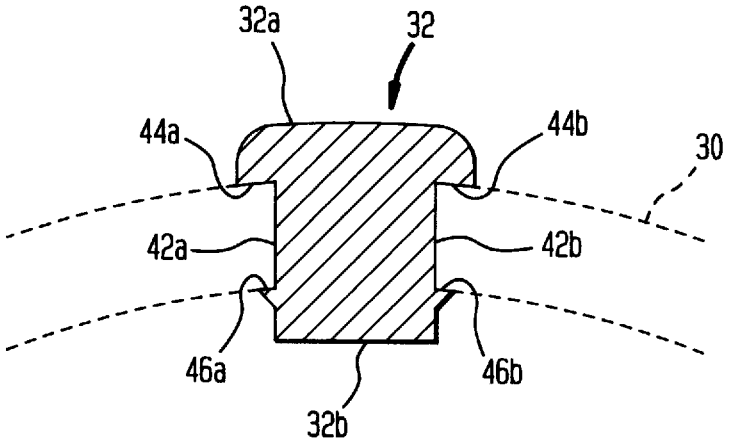
FIG. 7A is a cross-sectional view of a wringing grip insert in accordance with the second embodiment of the present invention.
Figure 7B:
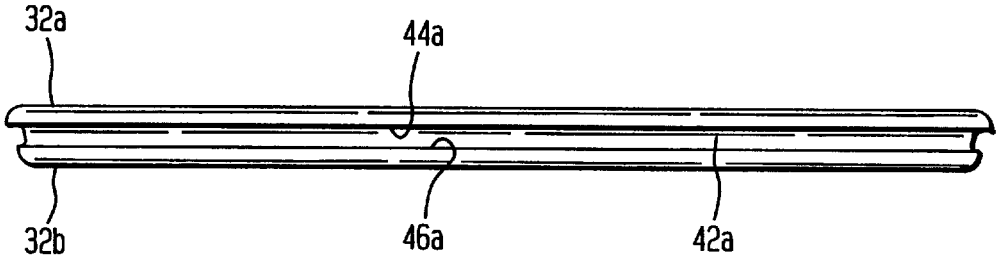
FIG. 7B is a side view of a wringing grip insert in accordance with the second embodiment of the present invention.

A cross-sectional view of one insert 32 is shown in greater detail in FIG. 7A. As can be seen in FIG. 7A, when insert 32 is fit into opening 34, outer portion 32*a*, extends outwardly from wringing grip 30 (shown in phantom) and inner portion 32*b* extends inwardly from wringing grip 30. Side portions 42*a* and 42*b* engage wringing grip 30 along the edges of wringing grip 30 which define opening 34. Upper lip portions 44*a* and 44*b* and lower lip portions 46*a* and 46*b* are formed and arranged around the entire periphery of insert 32, as is shown in FIG. 7B, which is a side view of insert 32. Insert 32 engages wringing grip 30 along the entire periphery of the edges of wringing grip 30 which define opening 34, such that upper lip portions 44*a* and 44*b* are fit flush against the outer surface of wringing grip 30, and lower lip portions 46*a* and 46*b* are fit flush against the inner surface of wringing grip 30. This arrangement results in insert 32 being tensionally engaged with wringing grip 30.

The outer portion 32*a* of inserts 32 provides a secure, non-slip grip area. When force is applied to inserts 32 in a radial direction toward handle 10, as in the direction shown by arrows 40, FIG. 6B, wringing grip 30 is compressed and the inner portion 32*b* of inserts 32 engage handle 10 to inhibit wringing grip 30 from rotating relative to handle 10. The mop of this embodiment is then able to be wrung as described with reference to the embodiment of FIGS. 2–4.

In this embodiment, inserts 32 are rubber. However, any material which is capable of frictionally engaging handle 10 may be utilized in the manufacture of inserts 32. Inserts 32 also need not include outer portion 32*a*, and therefore may be flush with the outer circumference of wringing grip 30.

In another embodiment, wringing grip 30 are formed to have integral inward protrusions instead of having separate inserts 32 fit into openings 34. These protrusions act to engage handle 10 in the same manner as inserts 32 when wringing grip 30 is compressed. These protrusions may be coated with a material such as rubber, plastic or urethane, which enhances the ability of the protrusions to frictionally engage handle 10.

In another embodiment, only the ends, and not the sides, of inserts 32 are fixed to wringing grip 30 at opposite ends of the openings 34, such that the center of inserts 32 is slightly bowed away from handle 10. Therefore, when radially inward force is applied to inserts 32, inserts 32 deflect inward to engage handle 10, without the need for wringing grip 30 to be compressed. In this embodiment, only the inserts are compressed. Since the inserts may be made from a very flexible material, the amount of force required to wring the mop head is greatly reduced.

In the preferred embodiment, wringing grip 30 is made from molded plastic. In another embodiment, wringing grip 30 may include a tackified or rubberized inner surface, in order to enhance the ability of wringing grip 30 to hold handle 10. However, any material having sufficient strength, pliability, friction and elasticity to enable the grip to be repeatedly compressed against the handle and released to its relaxed state may be used in the manufacture of wringing grip 30. Any wringing grip having such features would not necessarily need openings, holes or slots, and would be within the scope of the invention. Furthermore, the embodiment of FIGS. 2–4 may be converted to the embodiment of FIGS. 5–7 by retrofitting inserts 32 into openings 34 of the embodiment of FIGS. 2–4.

Having thus described an embodiment of the invention, various alterations, modifications, and improvements will readily occur to those skilled in the art. Such alterations, modifications, and improvements are intended to be within the spirit and scope of the invention. For example, the grip structure of fixed grip 20 and wringing grip 30 may include ergonomic, raised fin portions which facilitate the twisting of the handle and the wringing grip. Also within the scope of the invention are embodiments in which the wringing grip does not fully surround the handle but is still capable of being compressed against the handle to frictionally hold the handle in place relative to the wringing grip or in which only a portion of an otherwise rigid wringing grip is compressible against the handle. Accordingly, the foregoing description is by way of example only and is not intended to be limiting.

What is claimed is:

1. A mop, comprising:

a handle;

a mop head; and a wringing grip slidably and rotatably mounted on said handle, said mop head being coupled between said wringing grip and said handle, such that upon rotation of said wringing grip relative to said handle, said mop head is wrung;

said wringing grip including means for engaging said handle when said wringing grip is compressed against said handle, to facilitate wringing of said mop head by inhibiting said wringing grip from rotating relative to said handle.

2. The mop of claim 1, wherein said engaging means comprises at least one protrusion which extends inwardly from said wringing grip toward said handle.

3. The mop of claim 2, wherein said at least one protrusion comprises an insert which is located within at least one opening in said wringing grip.

4. The mop of claim 2, wherein said at least one protrusion is integral with said wringing grip.

5. The mop of claim 2, wherein said at least one protrusion comprises a plurality of longitudinal ribs disposed along an internal wall of said wringing grip.

6. The mop of claim 3, wherein said insert is made from rubber.

7. The mop of claim 1, wherein a cross-section of said wringing grip is circular.

8. The mop of claim 1, wherein a cross-section of said wringing grip is elliptical.

9. The mop of claim 1, wherein said wringing grip comprises a pliable material and said engaging means comprises a tackified surface on an internal wall of said wringing grip.

10. The mop of claim 3, wherein said insert is fixed to said wringing grip only at opposite ends of said insert, such that when a radially inward force is applied to said insert, a middle portion of said insert, between said opposite ends, engages said handle.

11. A wringing mechanism for a mop, comprising:

a pliable wringing grip having a bore through which a mop handle is inserted, a mop head being coupled between said wringing grip and said handle such that upon rotation of said wringing grip relative to said handle, said mop head is wrung;

said pliable wringing grip comprising at least one protrusion disposed along an internal wall of said pliable wringing grip and extending inwardly toward said handle;

whereby, upon application of an inwardly radial force to said wringing grip, said protrusion engages said handle, thereby inhibiting movement of said handle relative to said wringing grip.

12. The wringing mechanism of claim 11, wherein said at least one protrusion comprises at least one insert which is located within at least one opening in said wringing grip.

13. The wringing mechanism of claim 11, wherein said at least one protrusion is integral with said wringing grip.

14. The wringing mechanism of claim 12, wherein said at least one insert is made from rubber.

15. The wringing mechanism of claim 13, wherein said at least one protrusion comprises a tackified inner surface which engages said handle.

16. The wringing mechanism of claim 11, wherein a cross-section of said wringing grip is circular.

17. The wringing mechanism of claim 11, wherein a cross-section of said wringing grip is elliptical.

18. A mop, comprising:

a handle;

a mop head; and a grip slidably and rotatably mounted on said handle with the mop head coupled between the handle and the grip, such that upon rotation of the grip relative to the handle, the mop head is twisted;

said grip having an element that engages said handle when force in the direction of the handle is applied to the grip, thereby preventing the grip from rotating relative to said handle.

19. The mop of claim 18, wherein said element includes at least one protrusion which extends inwardly from said grip toward said handle.

20. The mop of claim 18, wherein said element includes an insert which is located within at least one opening in said grip.

* * * * *